US007350487B1

(12) United States Patent
Pfeiffer et al.

(10) Patent No.: US 7,350,487 B1
(45) Date of Patent: Apr. 1, 2008

(54) METHOD FOR REDUCING PHASER ROTATIONAL INSTABILITY IN AN INTERNAL COMBUSTION ENGINE

(75) Inventors: Jeffrey M. Pfeiffer, Frankenmuth, MI (US); Jongmin Lee, Pittsford, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/713,908

(22) Filed: Mar. 5, 2007

(51) Int. Cl.
*F01L 1/34* (2006.01)

(52) U.S. Cl. ..... 123/90.17; 123/90.15; 464/160

(58) Field of Classification Search ..... 123/90.15, 123/90.17, 90.16, 90.18, 90.27, 90.31; 464/1, 464/2, 160
See application file for complete search history.

(56) References Cited

U.S. PATENT DOCUMENTS 6,718,922 B2 4/2004 Yasui
6,729,280 B2 * 5/2004 Muraki ..... 123/90.15
6,732,691 B1 5/2004 Lee et al.

* cited by examiner

*Primary Examiner*—Ching Chang
(74) *Attorney, Agent, or Firm*—Paul L. Marshall

(57) ABSTRACT

A camshaft phaser control system for reducing rotor positional instability. A phaser system includes a target wheel mounted on the phaser rotor such that during camshaft rotation wheel teeth chop a signal to generate first and second interruption signals indicative of amplitude of rotor instability. An instability monitor is used to monitor the level of instability against predetermined acceptable levels, depending upon engine operating conditions (RPM, temperature). An excessive level of instability is established by engine calibration. When measured instability exceeds a predetermined threshold level for a predetermined period, an instability diagnostic becomes alarmed. A default strategy is used to correct the excessive instability by applying a bias to the phaser control duty cycle. The system continues to monitor the level of instability, and when instability falls below the threshold limit, normal phasing operation is resumed.

5 Claims, 4 Drawing Sheets

METHOD FOR REDUCING PHASER ROTATIONAL INSTABILITY IN AN INTERNAL COMBUSTION ENGINE

TECHNICAL FIELD

The present invention relates to camshaft phasers for internal combustion engines; more particularly, to methods for controlling the action of such camshaft phasers; and most particularly, to a method and apparatus for controlling such action, including a target wheel for measuring directly the phaser instability resulting from camshaft oscillatory torque, and a control response based upon such measurement.

BACKGROUND OF THE INVENTION

Camshaft phasers for varying the valve timing of internal combustion engines are well known. A phaser typically comprises a rotor element attached to the end of a camshaft and variably displaceable rotationally within a stator element driven by the engine crankshaft. Phasers typically are actuated by a pressure duty cycle of oil derived from the engine's main oil supply and selectively directed to chambers within the phaser to alter the phase relationship between the rotor and stator, and hence between the camshaft and crankshaft.

A torque-imposed instability is known in the art that can cause the phase relationship to vary from nominal during a rotational cycle of the camshaft. In opening a valve, the valve follower leaves the base circle portion of the cam lobe and begins to climb the rising edge of the eccentric portion, creating a resistive torque on the camshaft. At some point, the resistive (negative) torque reaches a maximum, then declines to zero, and then becomes a positive torque in the opposite direction as the follower descends the falling edge of the eccentric portion and the valve closes. Because of mechanical and hydraulic lash in the system, the actual rotor positions with respect to the stator may be significantly different from the intended nominal positions during valve opening and valve closing. The difference between the maximum negative and maximum positive angular departures from nominal is known in the art as "phaser instability."

A typical cam phaser in good working order exhibits a characteristic level of instability due to inherent mechanical and hydraulic lash in the system. The phaser behaves somewhat like a spring-damper, absorbing the shocks from the valvetrain events. Depending upon the oiling system conditions (pressure, temperature, aeration, etc.), the hydraulic system may become like a soft spring rather than a stiff spring. When the hydraulic system is soft, the rotor oscillates more and tends to drift from its desired position. Some amount of such phaser instability is expected and acceptable, but excessive instability is undesirable, being indicative of poor system performance, and may affect the effective cam timing of the engine.

What is needed is means for measuring the level of instability continually during engine operation, detecting when the level of instability changes, and causing the cam phaser and engine to take predetermined action when measured instability exceeds a predetermined threshold level.

It is a principal object of the invention to alarm instability changes and to cause the phaser to take predetermined action to reduce the level of phaser instability to minimize potential problems such as engine malfunction and emissions increase.

SUMMARY OF THE INVENTION

Briefly described, a camshaft phaser control system in accordance with the invention includes a target wheel mounted on a phaser rotor which in turn is rotatable with the camshaft. The target wheel is provided with first and second signal-chopping means, preferably in the form of first and second teeth, for measuring camshaft oscillatory instability. A first tooth is angularly placed with respect to one of the cam lobes such that the trailing edge of the first tooth coincides with the negative camshaft oscillation peak excursion. The second tooth is angularly placed with respect to the same cam lobe such that the trailing edge of the second tooth coincides with the positive camshaft oscillation peak excursion. The target wheel is mounted on the phaser such that during camshaft rotation each tooth chops a signal to generate first and second interruption signals. The true central angle between these trailing edges is accurately known, as is the average rotational speed of the camshaft at the time of measurement. Thus, an apparent central angle can be computed by an engine monitoring system. Because of negative torque on the camshaft during valve opening and positive torque during valve closing, the apparent central angle can become greater than the true angle, depending upon the position of the teeth with respect to the cam lobe. The deviation of the apparent angle from the true angle is a direct measurement of oscillatory instability of the camshaft about its nominal holding position.

Locating the teeth at these specific positions with respect to the cam lobe provides three important benefits. First, the system thus measures the maximum oscillatory instability in phaser performance, and therefore any increase in instability amplitude may be inferred as system malfunction. Second, such placement also maximizes the sensitivity of the system to such malfunction. Third, such placement makes the system least sensitive to changes in angular location of the peaks, which may shift as much as ten crank angle degrees with changes in engine speed.

An instability monitor is used to monitor the level of instability against predetermined acceptable levels, depending upon engine operating conditions (RPM, temperature). An excessive level of instability is established by engine calibration. When measured instability exceeds a predetermined threshold level for a predetermined period, a diagnostic becomes alarmed. A default strategy is then used to correct the excessive instability by applying a bias to the phaser control duty cycle. The system continues to monitor the level of instability, and when instability falls below the threshold limit, normal phasing operation is resumed.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
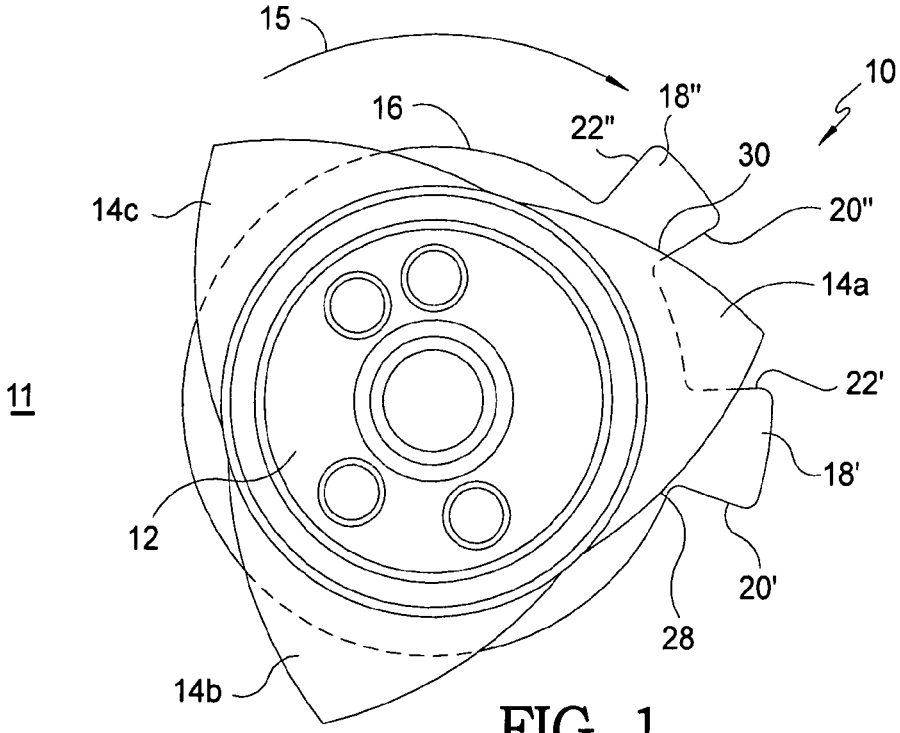
FIG. 1. (PRIOR ART)
FIG. 1 is an end view of a camshaft having a prior art target wheel for a camshaft phaser (phaser omitted for clarity), substantially as disclosed in U.S. Pat. No. 6,732,691 B1, the relevant disclosure of which is incorporated herein by reference.

Referring to FIG. 1, a prior art camshaft assembly 10 for an internal combustion engine 11, substantially as disclosed in incorporated U.S. Pat. No. 6,732,691, includes a shaft element 12 supporting three substantially identical cam lobes 14*a*,14*b*,14*c*. Camshaft assembly 10 is exemplarily an intake valve camshaft for a three-cylinder bank of a V-6 engine. A target wheel 16 mounted on camshaft 12 is provided with a plurality of angularly-discrete teeth 18',18" angularly positioned relative to cam lobe 14*a* as described below. (Of course, as the cam lobes are identical, they are indistinguishable, and either of the other two might equally be selected. Because the method of the invention requires rotational analysis of the camshaft only once per revolution, only one of the cam lobes need be involved.) Each tooth 18',18" has a leading edge 20',20" and a trailing edge 22',22", defined by the direction 15 of camshaft rotation. Teeth 18',18" intermittently intercept a source signal (not shown in FIG. 1) impingent upon a sensor (also not shown in FIG. 1) such as, for example, a Hall effect sensor, to produce a square wave (interrupted) signal indicative of known performance parameters of camshaft assembly 10. Typically, camshaft assembly 10 is connected to a camshaft phaser (not shown in FIG. 1 for clarity), and the performance parameters relate to the degree of valve timing advance or retard afforded by such a phaser during rotation 15 thereof during engine operation.

Figure 2:
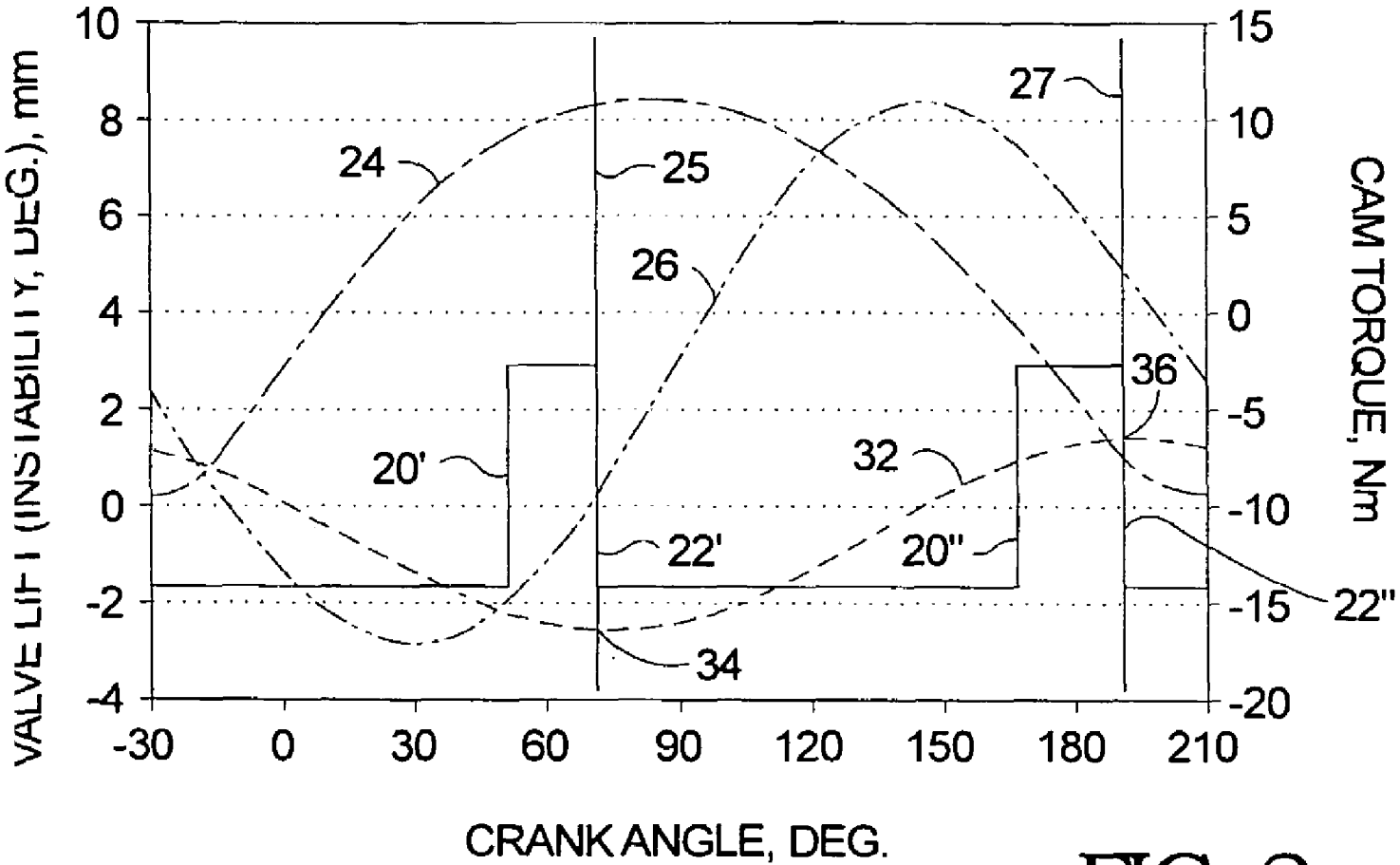
FIG. 2. (PRIOR ART)
FIG. 2 is a prior art graphical representation of the variation in valve opening distance, variation in camshaft torque, and variation in camshaft instability as a function of engine crankshaft angle, having a target wheel signal-chopping function superimposed thereupon.

Referring to FIG. 2, several activities are shown simultaneously as a function of the rotation of an engine crankshaft coupled to engine camshaft assembly 10 via a camshaft phaser. Recall that in a four-stroke engine, the crankshaft rotates twice for each rotation of the camshaft; thus, each lobe 14 in the example 10 shown herein has an actuation domain, from the start of its rising edge to the end of its falling edge, of 240 crank angle degrees.

Curve 24 shows the lift in millimeters of a typical engine valve through opening and closing by cam lobe 14*a*. Curve 26 shows the torque in Newton-meters imposed on camshaft assembly 10 by actuation of the valve cam follower for lobe 14*a*. Note that the initial torque value is negative (counter to camshaft rotation 15) as the follower begins to ascend the opening flank (rising edge) 28 of lobe 14*a* (FIG. 1), reaching a minimum of approximately −16 Nm when the valve is about half-open; then becomes increasingly positive (in the direction 15 of camshaft rotation), passing through 0 just ahead of the peak opening of the valve; reaches a maximum value in excess of +11 Nm when the follower is descending the closing flank (falling edge) 30 of the lobe and the valve is about half-closed; and remains positive through the remainder of the valve cycle until the follower is once again on the base circle portion of the cam lobe.

The alternating negative and positive torque exerted on the camshaft (and hence the rotor) causes an oscillatory instability in the instantaneous camshaft angular position during valve actuation by each lobe 14*a*,14*b*,14*c*, as shown in curve 32 in FIG. 2 wherein instability is expressed in angular deviation from nominal (0) during actuation by a single lobe 14*a*. In the example shown, the instability curve 32 nearly mirrors the valve opening curve 24, reaching a minimum of about −2.5 degrees near the valve opening peak and a maximum of about +1.5 degrees when the valve is nearly closed again. The effect of such torque fluctuation on the camshaft is that the valve opening is slightly delayed and the valve closing is slightly accelerated from nominal. Because of mechanical and hydraulic lash in the valve actuation system, including the cam phaser, a modest characteristic phaser hold instability is to be expected and can be accommodated at a fixed and steady-state net (peak-to-peak) amplitude.

Figure 3:
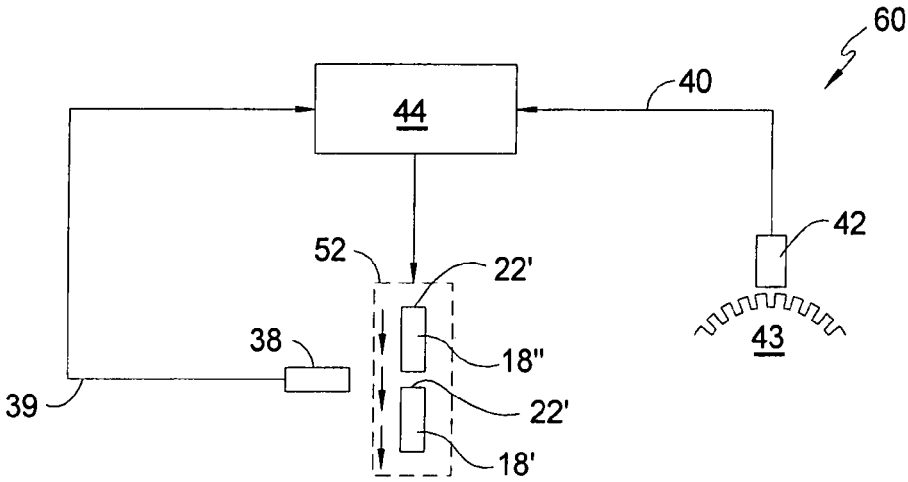
FIG. 3. (PRIOR ART)
FIG. 3 is a prior art schematic drawing of a camshaft phaser control system.

Referring to FIGS. 1 through 3, first tooth 18' is angularly placed with respect to rising edge 28 of cam lobe 14*a* such that trailing edge 22' coincides with the peak point of the negative camshaft oscillation peak excursion 34, graphically shown as point 25 in FIG. 2. Second tooth 18" is angularly placed with respect to falling edge 30 of the same cam lobe such that trailing edge 22" coincides with the peak point of the positive camshaft oscillation excursion 36, graphically shown as point 27 in FIG. 2. As shown in FIG. 1 and schematically in FIG. 3, in an engine phaser control system 60, teeth 18', 18" are positioned with respect to lobe 14*a* such that during a full rotation of target wheel 16', the trailing edge 22', 22" of each tooth induces a signal received by a receiver 38, as for example, a Hall effect sensor. The receiver 38, in turn, transmits a signal 39 to an electronic monitoring system (EMS) 44, in known fashion. The EMS also receives a signal 40 from crankshaft position sensor 42 which determines the precise angular position of the crankshaft 43 in its rotation and that provides an instantaneous reference for the camshaft angular position.

With the camshaft phaser system in good working order, a baseline level of phaser instability is measured by EMS 44 by algorithm, based on received signals 39 and 40. This measurement is taken every camshaft rotation. Thus, any changes to the baseline level of phaser instability, as measured by EMS 44, is a direct measurement of an increase in holding position instability of the phaser.

Figure 5:
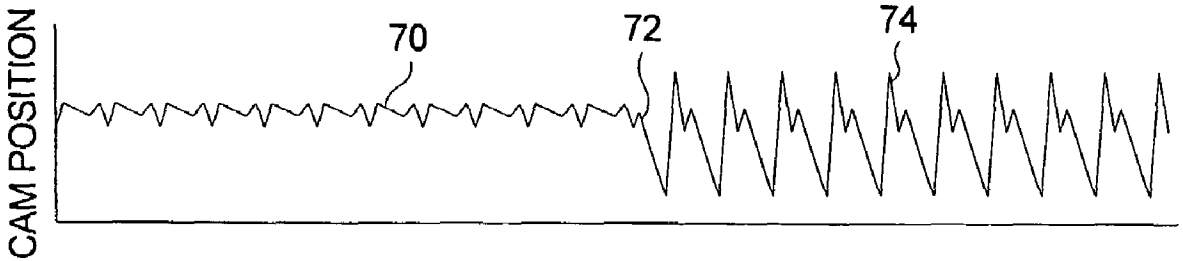
FIG. 5 is a first graph of cam position as a function of time, showing acceptable phaser instability changing to unacceptable phaser instability.

In accordance with the present invention, instability amplitude can be monitored and controlled continuously as an operating characteristic of a cam phaser system. Referring to FIGS. 3 and 5, a baseline level of phaser instability is indicated by portion 70 of the cam position curve. At point 72, phaser instability suddenly increases to an unacceptable level, as shown in portion 74. Increases in the amplitude of instability during engine operation can signify degraded performance of the phaser, as may be caused by drop in phaser actuating oil pressure, oil filter clogging, oil aeration, etc. Such increases 74 are signals for EMS 44 to take defensive action 52 in accordance with the present invention, until such time as the amplitude returns to an acceptable value 70.

Figure 4:
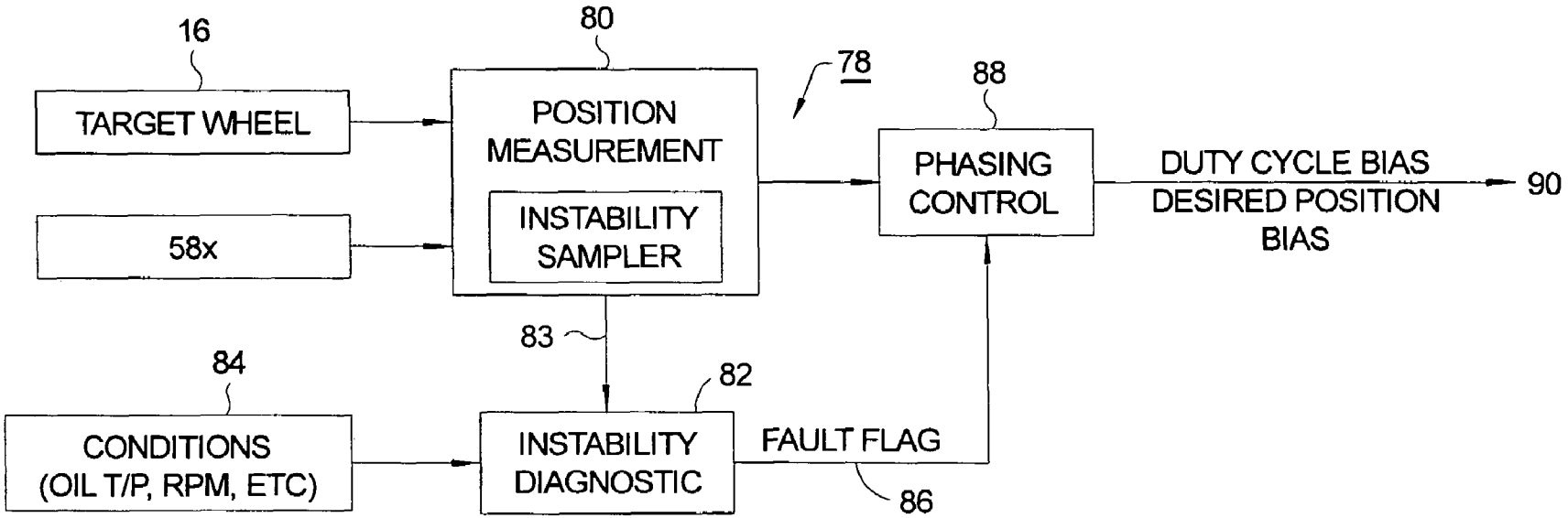
FIG. 4 is a schematic drawing of an instability control system in accordance with the invention.
Figure 6:
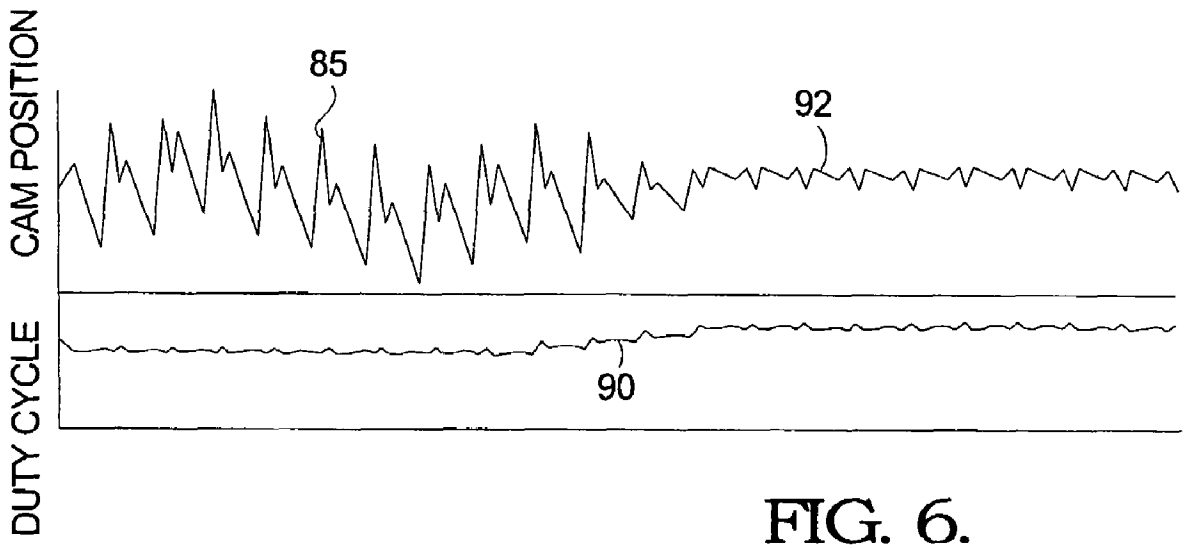
FIG. 6 is a second graph of cam position as a function of time, showing unacceptable phaser instability being corrected in accordance with the invention by increasing the phaser control (advance) duty cycle.

Referring now to FIGS. 4 and 6, a method 78 in accordance with the invention is shown for adjusting the action of a camshaft phaser to reduce excessive instability when a predetermined amplitude alarm limit is reached.

There are three elements in the method: measurement, diagnosis, and default strategy. A fourth element, diagnostic failure, may be implemented in the event that the default strategy repeatedly fails to correct the instability. A service P-code is stored for the variable cam phasing system. This is not necessarily an emissions-type failure. The calibration for the specific application determines whether the failure is treated as emissions-type or service-only.

Measurement: The instability is measured by sampling the actual phasing position at specific cam target teeth, for example, teeth 18',18" on target wheel 16 to provide peak-to-peak position oscillation as described above. A measurement algorithm 80 keeps track of which tooth on the target wheel is presently being measured. The instability is measured only when the phasing system is at a steady-state, non-default position, away from the stop/end positions. Transient operation is not useful for measuring instability.

Diagnosis: A diagnostic 82 monitors the level of instability 83 against predetermined acceptable levels, depending upon engine operating conditions 84 such as speed and oil temperature. The definition of excessive level of instability is predetermined by engine calibration in known fashion. When this level 85 (FIG. 6) is detected, an internal system alert 86 is activated. A default strategy 88 is then implemented to correct the excessive instability. In a presently preferred embodiment, the diagnostic 82 repeatedly executes a 125 millisecond loop and retrieves the latest available instability measurement 83. The diagnostic 82 is enabled only if there are no measurement faults present.

Default Strategy: The default strategy 88 for instability is to bias the control duty cycle 90 of the phaser to allow more oil to flow into the phaser on the side ("actuating side") of the phaser that opposes the drift or eliminates oscillation. This is usually the side of the phaser that works against the valvetrain, but may be either side. The valvetrain and camshaft tend to drive the phaser in a net timing-retard direction. The bias of duty cycle and associated oil volume restores the stiffness of the hydraulic system, thus reducing the level of instability to an acceptable level 92 (FIG. 6).

In a presently preferred embodiment, the default function detects the need for action by observing whether fail counts from the diagnostic have reached a small threshold. This threshold is separate from the fail threshold in the diagnostic, so that the default function can be activated before the diagnostic fails. A threshold of zero is not used so that unnecessary activity in the default function can be avoided, should there be any incidental fail counts in the diagnostic. The bias is applied by capturing the value of the integral at the time that the instability diagnostic starts to fail. A calibrated bias duty cycle is added to this failing integral value. The minimum integral is then clamped at the resulting biased duty cycle.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A method for reducing instability of rotational holding position of a rotor in a stator of a camshaft phaser during operation thereof by an associated internal combustion engine, wherein the camshaft phaser includes a plurality of actuating chambers selected from a plurality of timing-advance chambers and timing-retard chambers, the actuating chambers being supplied selectively with oil according to a selected duty cycle for providing a predetermined rotational holding position of the rotor within the stator, and wherein the camshaft phaser includes a target wheel for creating interrupted signals, the amplitudes of which are indicative of the magnitude of the instability, the method comprising the steps of:

a) providing a predetermined alarm level for said instability amplitude as indicated by said interrupted signals;

b) monitoring said instability amplitude of said interrupted signals;

c) activating a default correction function when said instability amplitude exceeds said predetermined alarm level; and d) operating said default correction function to apply a bias to said selected duty cycle in service of said actuating chambers.

2. A method of reducing stability, in accordance with claim 1 wherein, in said operating step, said bias is applied to increase said selected duty cycle to reduce said instability of rotational holding position.

3. A method of reducing stability, in accordance with claim 1 wherein said predetermined alarm level is provided based on engine operating conditions.

4. A method of reducing stability, in accordance with claim 3 wherein said engine operating conditions include oil temperature.

5. A method of reducing stability, in accordance with claim 3 wherein said engine operating conditions include engine speed.

* * * * *